US009995302B2

(12) United States Patent
Yano et al.

(10) Patent No.: US 9,995,302 B2
(45) Date of Patent: Jun. 12, 2018

(54) MOTOR DRIVEN COMPRESSOR

(71) Applicant: KABUSHIKI KAISHA TOYOTA JIDOSHOKKI, Kariya-shi, Aichi-ken (KE)

(72) Inventors: Junya Yano, Kariya (JP); Tsuyoshi Yamaguchi, Kariya (JP); Takashi Kawashima, Kariya (JP); Yoshiki Nagata, Kariya (JP)

(73) Assignee: KABUSHIKI KAISHA TOYOTA JIDOSHOKKI, Kariya-shi, Aichi-ken (JP)

( * ) Notice: Subject to any disclaimer, the term of this patent is extended or adjusted under 35 U.S.C. 154(b) by 344 days.

(21) Appl. No.: 15/047,068

(22) Filed: Feb. 18, 2016

(65) Prior Publication Data

US 2016/0245288 A1 Aug. 25, 2016

(30) Foreign Application Priority Data

Feb. 20, 2015 (JP) ..... 2015-031938

(51) Int. Cl.
*F04C 28/06* (2006.01)
*F04B 35/04* (2006.01)
(Continued)

(52) U.S. Cl.
CPC ..... *F04C 28/06* (2013.01); *F04B 35/04* (2013.01); *F04B 49/06* (2013.01); *F04B 49/10* (2013.01);
(Continued)

(58) Field of Classification Search
CPC ..... F04C 28/06; F04B 35/04
(Continued)

(56) References Cited

U.S. PATENT DOCUMENTS 7,053,587 B2 * 5/2006 Ito ..... H02P 27/085 318/721

FOREIGN PATENT DOCUMENTS

JP 2002262580 A 9/2002
JP 2003-324900 A 11/2003
(Continued)

OTHER PUBLICATIONS

Communication dated Mar. 21, 2017, from the Japanese Patent Office in counterpart application No. 2015-031938.

*Primary Examiner* — David S Luo
(74) *Attorney, Agent, or Firm* — Sughrue Mion, PLLC

(57) ABSTRACT

A motor-driven compressor includes an electric motor, a drive circuit, a modulation method controller, a temperature measuring section, a high-temperature (HT) stop controller, and a high-temperature (HT) stop temperature setting section. The high-temperature (HT) stop controller stops the electric motor when the temperature measured by the temperature measuring section is higher than or equal to a predetermined high-temperature (HT) stop temperature. When the modulation method is the three-phase modulation, the HT stop temperature setting section sets the HT stop temperature to a three-phase high-temperature (HT) stop temperature. When the modulation method is the two-phase modulation, the HT stop temperature setting section sets the HT stop temperature to a two-phase high-temperature (HT) stop temperature, which is higher than the three-phase HT stop temperature.

8 Claims, 4 Drawing Sheets

(51) Int. Cl.

| | |
|---|---|
| ***F04B 49/06*** | (2006.01) |
| ***F04C 28/28*** | (2006.01) |
| ***F04C 29/00*** | (2006.01) |
| ***F04B 49/10*** | (2006.01) |
| *F04C 18/02* | (2006.01) |
| *F04C 18/34* | (2006.01) |

(52) U.S. Cl.
CPC ..... *F04C 28/28* (2013.01); *F04C 29/0085* (2013.01); *F04B 2203/0205* (2013.01); *F04C 18/0215* (2013.01); *F04C 18/34* (2013.01); *F04C 2240/808* (2013.01); *F04C 2240/81* (2013.01); *F04C 2270/195* (2013.01); *F04C 2270/80* (2013.01); *F04C 2270/86* (2013.01)

(58) Field of Classification Search
USPC ..... 318/811, 810, 807, 767, 727
See application file for complete search history.

(56) References Cited

FOREIGN PATENT DOCUMENTS

| | | | |
|---|---|---|---|
| JP | 2007288858 | A | 11/2007 |
| JP | 2012044866 | A | 3/2012 |

* cited by examiner

MOTOR DRIVEN COMPRESSOR

BACKGROUND OF THE INVENTION

The present invention relates to a motor-driven compressor.

Conventionally, a motor-driven compressor has been known that includes a housing, into which refrigerant is drawn, a compression portion, which is accommodated in the housing and compresses fluid, an electric motor, which is accommodated in the housing and drives the compression portion, and a drive circuit, which drives the electric motor. For example, refer to Japanese Laid-Open Patent Publication No. 2003-324900. The publication also describes that the drive circuit is attached to the outer surface of the housing and that heat exchange takes place between the fluid and the drive circuit via the housing to cool the drive circuit.

Depending on the ambient temperature about the motor-driven compressor or the drawn-in fluid temperature, which is the temperature of the fluid drawn into the housing, the temperature of the drive circuit may exceed the upper limit of the guaranteed operation range of the drive circuit or may be lowered below the lower limit of the guaranteed operation range. In such cases, the drive circuit may malfunction. On the other hand, the motor-driven compressor is desired to operate continuously as long as possible in some cases.

SUMMARY OF THE INVENTION

Accordingly, it is an objective of the present invention to provide a motor-driven compressor configured to continue to operate while restraining the temperature of the drive circuit from being excessively high or excessively low.

To achieve the foregoing objective and in accordance with one aspect of the present invention, a motor-driven compressor is provided that includes a housing, into which fluid is drawn, a compression portion, an electric motor, a drive circuit, a modulation method controller, a temperature measuring section, a high-temperature (HT) stop controller, and a high-temperature (HT) stop temperature setting section. The compression portion is accommodated in the housing and compresses and discharges the fluid. The electric motor is accommodated in the housing and drives the compression portion. The drive circuit drives the electric motor. The modulation method controller sets a modulation method of the drive circuit to a three-phase modulation or a two-phase modulation. The temperature measuring section measures a temperature of the drive circuit. The HT stop controller stops the electric motor when the temperature measured by the temperature measuring section is higher than or equal to a predetermined high-temperature (HT) stop temperature. When the modulation method is the three-phase modulation, the HT stop temperature setting section sets the HT stop temperature to a three-phase high-temperature (HT) stop temperature. When the modulation method is the two-phase modulation, the HT stop temperature setting section sets the HT stop temperature to a two-phase high-temperature (HT) stop temperature, which is higher than the three-phase HT stop temperature.

Other aspects and advantages of the present invention will become apparent from the following description, taken in conjunction with the accompanying drawings, illustrating by way of example the principles of the invention.

BRIEF DESCRIPTION OF THE DRAWINGS

The invention, together with objects and advantages thereof, may best be understood by reference to the following description of the presently preferred embodiments together with the accompanying drawings in which.

DETAILED DESCRIPTION OF THE PREFERRED EMBODIMENTS

A motor-driven compressor 10 according to one embodiment will now be described. The motor-driven compressor 10 of the present embodiment is mounted on a vehicle and employed in the vehicle air conditioner 100. That is, in the present invention, the fluid to be compressed by the motor-driven compressor 10 is refrigerant.

Figure 1:
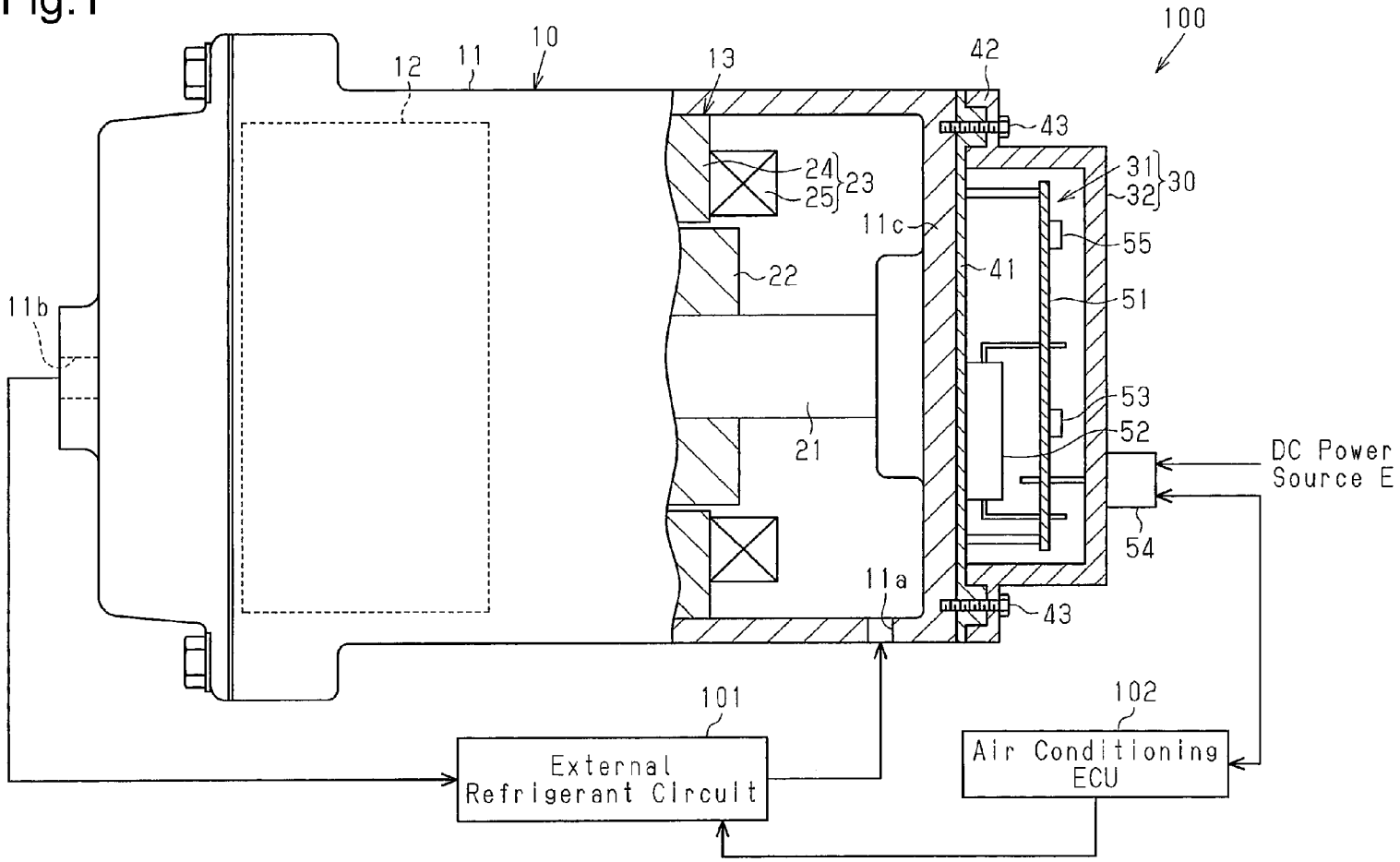
FIG. 1 is a schematic diagram of a motor-driven compressor and a vehicle air conditioner.

As shown in FIG. 1, the vehicle air conditioner 100 includes the motor-driven compressor 10 and an external refrigerant circuit 101, which supplies refrigerant to the motor-driven compressor 10. The external refrigerant circuit 101 includes, for example, a heat exchanger and an expansion valve. The motor-driven compressor 10 compresses refrigerant, and the external refrigerant circuit 101 performs heat exchange of the refrigerant and expands the refrigerant. This allows the vehicle air conditioner 100 to cool or warm the passenger compartment.

The vehicle air conditioner 100 includes an air conditioning ECU 102, which controls the entire vehicle air conditioner 100. The air conditioning ECU 102 is configured to obtain parameters such as the temperature of the passenger compartment and a target temperature. Based on the parameters, the air conditioning ECU 102 outputs various commands such as an ON-OFF command to the motor-driven compressor 10.

The motor-driven compressor 10 includes a housing 11, a compression portion 12, and an electric motor 13. The housing 11 has an inlet 11*a*, into which refrigerant from the external refrigerant circuit 101 is drawn. The compression portion 12 and the electric motor 13 are accommodated in the housing 11.

The housing 11 is substantially cylindrical as a whole and made of a thermally conductive material (a metal such as aluminum). The housing 11 has an outlet through which refrigerant is discharged.

The compression portion 12 compresses refrigerant that has been drawn into the housing 11 through the inlet 11*a* and discharges the compressed refrigerant through the outlet 11*b*. The compression portion 12 may be any type such as a scroll type, a piston type, and a vane type.

The electric motor 13 drives the compression portion 12. The electric motor 13 includes a rotary shaft 21, which is rotationally supported, for example, by the housing 11, a cylindrical rotor 22, which is fixed to the rotary shaft 21, and a stator 23 fixed to the housing 11. The axis of the rotary shaft 21 coincides with the axis of the cylindrical housing 11. The stator 23 includes a cylindrical stator core 24 and coils 25 wound about the teeth of the stator core 24. The rotor 22 and the stator 23 face each other in the axial direction of the rotary shaft 21.

As shown in FIG. 1, the motor-driven compressor 10 includes an inverter unit 30, which includes an inverter 31 and a case 32. The inverter 31 serves as a drive circuit that drives the electric motor 13, and the case 32 accommodates the inverter 31. The coils 25 of the electric motor 13 and the inverter 31 are connected to each other by connectors (not shown).

The case 32 is made of a material having a heat transferring property (for example, a metal such as aluminum) and includes a plate-like base member 41 and a cylindrical cover member 42, which has a closed end and assembled to the base member 41. The base member 41 contacts the housing 11. Specifically, the base member 41 contacts a wall portion 11*c*, which is one of the wall portions on the opposite sides in the axial direction of the housing and is located on the side opposite from the outlet 11*b*. In this state, the base member 41 is fixed to the housing 11 with bolts 43, which function as fasteners. Accordingly, the case 32, which accommodates the inverter 31, is attached to the housing 11. That is, the inverter 31 is integrated with the motor-driven compressor 10 of the present embodiment.

The inverter 31 includes, for example, a circuit board 51 and a power module 52, which is electrically connected to the circuit board 51. The circuit board 51 has various electronic components and a wiring pattern. A temperature sensor 53 is mounted on the circuit board 51. The temperature sensor 53 serves as a temperature measuring section that measures, for example, the temperature of the inverter 31. The temperature sensor 53 directly or indirectly measures the temperature of the inverter 31. For example, the temperature sensor 53 detects the ambient temperature inside the case 32 as a temperature indirectly representing the temperature of the inverter 31. A connector 54 is provided on the outer surface of the case 32. The circuit board 51 and the connector 54 are electrically connected to each other. The inverter 31 receives power from a DC power source E, which serves as an external power source, via the connector 54. The air conditioning ECU 102 and the inverter 31 are electrically connected to each other.

The inverter 31 is arranged at a position that is thermally coupled to the housing 11. Specifically, the power module 52 of the inverter 31 contacts the base member 41. As described above, the base member 41 contacts the wall portion 11*c* of the housing 11. Thus, the inverter 31 (more specifically, the power module 52) and the housing 11 are thermally coupled to each other via the base member 41.

Figure 2:
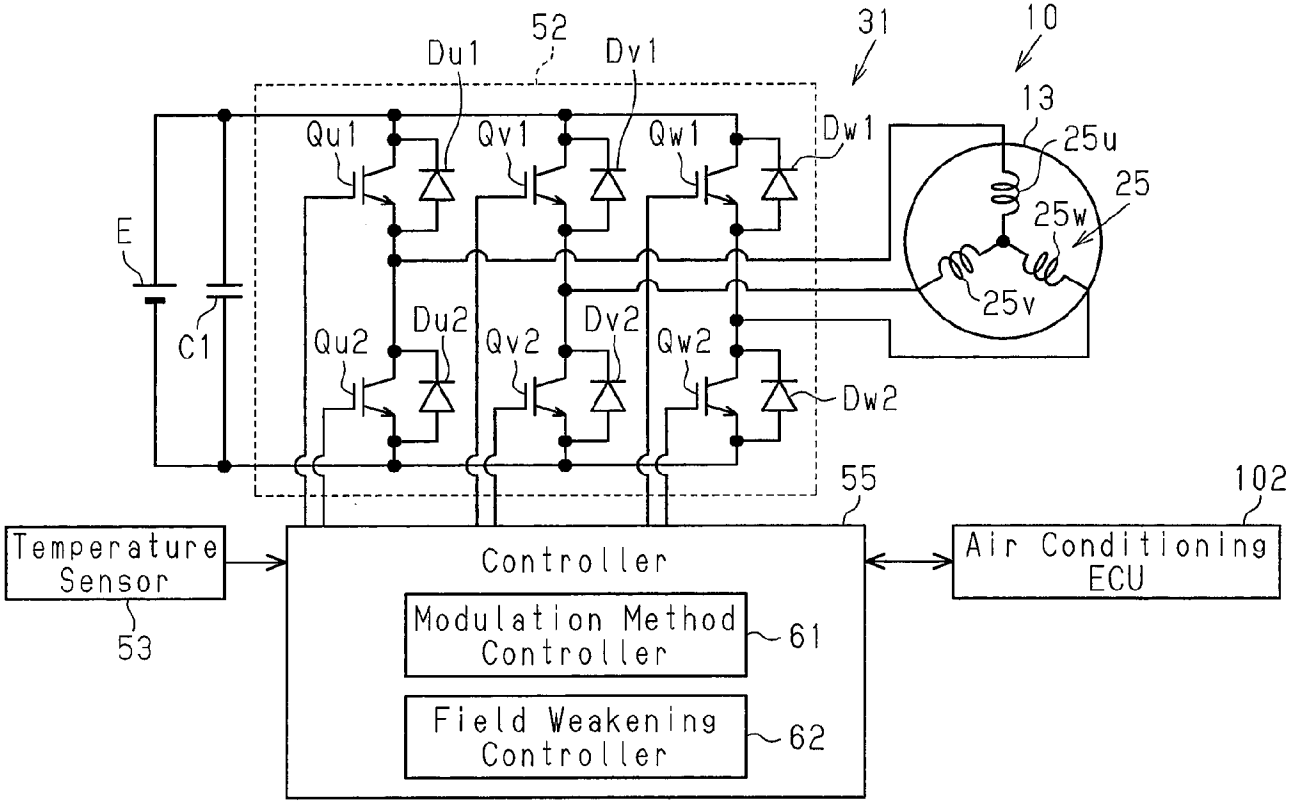
FIG. 2 is a circuit diagram showing the electrical configuration of the motor-driven compressor.

As shown in FIG. 2, the coils 25 of the electric motor 13 are of a three-phase structure, for example, with a u-phase coil 25*u*, a v-phase coil 25*v*, and a w-phase coil 25*w*. That is, the electric motor 13 is a three-phase motor. The coils 25*u* to 25*w* are connected in a Y-connection.

The power module 52 includes u-phase power switching elements Qu1, Qu2 corresponding to the u-phase coil 25*u*, *v*-phase power switching elements Qv1, Qv2 corresponding to the v-phase coil 25*v*, and w-phase power switching elements Qw1, Qw2 corresponding to the w-phase coil 25*w*. That is, the inverter 31 is a three-phase inverter.

The switching elements Qu1, Qu2, Qv1, Qv2, Qw1, and Qw2 (hereinafter, simply referred to as the switching elements Qu1 to Qw2) are each constituted, for example, by an insulated gate bipolar transistor (IGBT). Each of the switching elements Qu1 to Qw2 operates normally when its temperature is higher than or equal to a predetermined operation lower limit temperature Tmin and lower than or equal to a predetermined operation upper limit temperature Tmax.

The operation upper limit temperature Tmax is the upper limit of the guaranteed operation range of the power switching elements Qu1 to Qw2. In other words, the operation upper limit temperature Tmax is the upper limit of the guaranteed operation range of the inverter 31. The operation lower limit temperature Tmin is the lower limit of the guaranteed operation range of the power switching elements Qu1 to Qw2. In other words, the operation lower limit temperature Tmin is the lower limit of the guaranteed operation range of the inverter 31.

The u-phase power switching elements Qu1, Qu2 are connected to each other in series by a connection wire that is connected to the u-phase coil 25*u*. The connection body of the u-phase power switching elements Qu1, Qu2 receives the DC power of the DC power source E. Except for the connected coil, the other switching elements Qv1, Qv2, Qw1, Qw2 have the same connection structure as the u-phase power switching elements Qu1, Qu2, and the descriptions thereof are omitted. The DC power source E is, for example, an electric storage device such as a battery or an electric double-layer capacitor.

The inverter 31 includes a smoothing capacitor C1, which is connected in parallel with the DC power source E. The power module 52 includes freewheeling diodes Du1 to Dw2, which are respectively connected in parallel with the power switching elements Qu1 to Qw2.

The motor-driven compressor 10 includes a controller 55, which controls the inverter 31 (specifically, switching of the power switching elements Qu1 to Qw2). The controller 55 is connected to the gates of the power switching elements Qu1 to Qw2. The controller 55 periodically switches ON and OFF the power switching elements Qu1 to Qw2 to drive, or rotate, the electric motor 13.

The controller 55 executes pulse width modulation control (PWM control) on the inverter 31. Specifically, the controller 55 uses a carrier signal and a commanded voltage value signal (signal for comparison) to generate a control signal. The controller 55 executes ON-OFF control on the power switching elements Qu1 to Qw2 by using the generated control signal, thereby converting a DC power to an AC power. The AC power obtained through the conversion is supplied to the electric motor 13 to drive the motor 13.

Further, the controller 55 controls the control signal to vary the duty cycle of the ON-OFF of the power switching elements Qu1 to Qw2. By varying the duty cycle, the controller 55 controls the rotational speed (number of revolutions per unit time) of the electric motor 13. The controller 55 is electrically connected to the air conditioning ECU 102. When receiving information related to a target rotational speed from the air conditioning ECU 102, the controller 55 causes the electric motor 13 to rotate at the target rotational speed. Hereinafter, the rotational speed of the electric motor 13 will be simply referred to as a rotational speed.

Further, the controller 55 controls the control signal to control a modulation factor, which is the ratio of the amplitude of the AC voltage output by the inverter 31 to the voltage of the DC power source E (hereinafter, simply referred to as a power source voltage). The controller 55 obtains the power source voltage and a required voltage, which corresponds to a voltage required to drive the electric motor 13, and controls the modulation factor M in accordance with the power source voltage such that the output voltage of the inverter 31 becomes the required voltage.

As shown in FIG. 2, the controller 55 includes a modulation method controller 61, which controls the modulation method of the inverter 31 (hereinafter, simply referred to as a modulation method). The modulation method will now be described.

In the present embodiment, the modulation method of the inverter 31 includes a three-phase modulation and a two-phase modulation. The three-phase modulation is a modulation method in which the power switching elements Qu1 to Qw2 of all the phases are always subjected to periodic ON-OFF operation (switching operation). In the present embodiment, the two-phase modulation is a modulation method in which periodic ON-OFF operation of one of the power switching elements Qu1 to Qw2, that is, periodic ON-OFF operation of the power switching element of one of the three phases, is sequentially stopped every predetermined period (phase angle). That is, the two-phase modulation is a modulation method in which the periodic ON-OFF operation of the power switching element of one of the three phases is sequentially stopped, and periodic ON-OFF operations of the power switching elements of the other two phases are executed. The state in which the periodic ON-OFF operation of a power switching element is stopped refers to a state in which the power switching element remains switched ON or OFF.

Compared to the three-phase modulation, the power switching elements Qu1 to Qw2 are less frequently switched ON and OFF. Thus, the power loss and the amount of heat generation of the inverter 31 are more likely to be increased in the three-phase modulation than in the two-phase modulation.

Compared to the two-phase modulation, the three-phase modulation is configured to accurately control the voltage waveform flowing through the coils 25*u* to 25*w* and is likely to reduce the current ripples. Thus, the three-phase modulation is preferably employed, for example, in a case in which the load applied to the electric motor 13 is relatively great.

In the two-phase modulation of the present embodiment, for example, the power switching elements Qu1, Qv1, Qw1 on the upper arm and the power switching elements Qu2, Qv2, Qw2 on the lower arm are both employed. In other words, the power switching elements Qu1 to Qw2 are each subjected to stopping.

In a situation in which the modulation method is the three-phase modulation, the modulation method controller 61 shifts the modulation method from the three-phase modulation to the two-phase modulation when that a predetermined two-phase modulation condition is met. The two-phase modulation condition is defined, for example, by at least one of a rotational speed and a modulation factor. Specifically, the two-phase modulation condition may be met when the rotational speed is greater than or equal to a predetermined threshold rotational speed and the modulation factor is greater than or equal to a predetermined threshold modulation factor.

In a situation in which the modulation method is the two-phase modulation, the modulation method controller 61 shifts the modulation method from the two-phase modulation to the three-phase modulation when that the two-phase modulation condition is no longer met.

That is, the two-phase modulation is employed when the rotational speed is relatively high. The flow rate of refrigerant drawn into the housing 11 increases as the rotational speed increases. Thus, when the modulation method is the two-phase modulation, the flow rate of refrigerant drawn into the housing 11 tends to be increased compared to a case in which the modulation method is the three-phase modulation.

As shown in FIG. 2, the controller 55 includes a field weakening controller 62, which executes field weakening control on the electric motor 13 when a predetermined field weakening condition is met. The field weakening condition, for example, refers to a state in which the counter electromotive force generated in the motor 13 is equal to the power source voltage.

If the rotational speed of the electric motor 13 is increased when the power source voltage is low, the magnetic flux generated by the rotation of the electric motor generates counter electromotive force. When the counter electromotive force becomes equal to the power source voltage applied to the electric motor 13, the rotational speed of the electric motor 13 can no longer be increased.

In contrast, the field weakening control suppresses counter electromotive force generated by rotation of the electric motor 13. Specifically, the field weakening control suppresses counter electromotive force by causing the inverter 31 to output, to the electric motor 13, a current that weakens the magnetic flux generated by rotation of the electric motor 13. Thus, even in a case in which the power source voltage is relatively low, the motor-driven compressor is allowed to operate at a high rotational speed while maintaining a high constant torque.

The field weakening control is executed, for example, when the modulation method is the two-phase modulation and overmodulation control is being executed. In the overmodulation control, a power switching element that is an object to be operated is maintained in an ON state for a predetermined period longer than the carrier period. The field weakening control is executed under an environment of a relatively low power source voltage. Thus, the power loss and the amount of heat generation of the inverter 31 are more likely to be reduced in the field weakening control than in the normal control. The power switching element that is an object to be operated refers to a power switching element other than the power switching elements in a stopped phase.

The temperature sensor 53 delivers the measurement result to the controller 55. This allows the controller 55 to obtain a measured temperature Tm, which is measured by the temperature sensor 53. The controller 55 periodically executes a high-temperature (HT) stop control process and a low-temperature (LT) stop control process to execute stop control of the motor-driven compressor 10 (specifically, the electric motor 13) such that the temperature of the inverter 31 remains in the guaranteed operation range during operation of the motor-driven compressor 10 (that is, during rotation of the electric motor 13).

The HT stop control process is configured to stop operation of the motor-driven compressor 10 when the measured temperature Tm is higher than or equal to a predetermined high-temperature (HT) stop temperature Th. The HT stop temperature Th is set to be lower than the operation upper limit temperature Tmax. The controller 55 varies the HT stop temperature Th in accordance with the control mode of the inverter 31. The details of the HT stop control process will now be described in combination with the control for varying the HT stop temperature Th.

Figure 3:
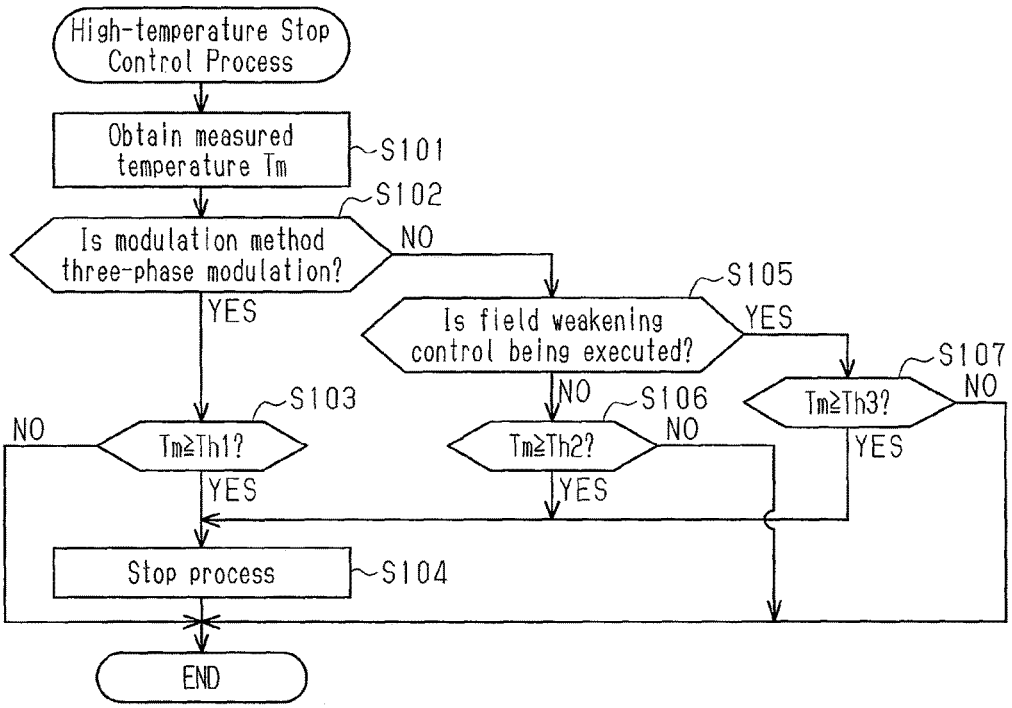
FIG. 3 is a flowchart of a high-temperature (HT) stop control process.

As shown in FIG. 3, the controller 55 obtains the measured temperature Tm from the measurement result of the temperature sensor 53 at step S101. Then, at step S102, the controller 55 determines whether the current modulation method is the three-phase modulation. If the current modulation method is the three-phase modulation, the controller 55 makes a positive determination at step S102 and proceeds to step S103. At step S103, the controller 55 determines whether the measured temperature Tm obtained at step S101 is higher than or equal to a predetermined three-phase high-temperature (HT) stop temperature Th1. The three-phase HT stop temperature Th1 is a value of the HT stop temperature Th that is set when the modulation method is the three-phase modulation.

If the measured temperature Tm is lower than the three-phase HT stop temperature Th1, the controller 55 ends the HT stop control process without further processing. In contrast, if the measured temperature Tm is higher than or equal to the three-phase HT stop temperature Th1, the controller 55 executes a stop process for stopping the electric motor 13 at step S104 and ends the HT stop control process. In the stop process, the controller 55 stops the periodic ON-OFF operation of the power switching elements Qu1 to Qw2.

If the current modulation method is not the three-phase modulation, that is, if the current modulation is the two-phase modulation, the controller 55 makes a negative determination at step S102 and proceeds to step S105 as shown in FIG. 3. At step S105, the controller 55 determines whether the field weakening control is being executed. If the field weakening control is not being executed, that is, if the field weakening controller 62 is not executing the field weakening control, the controller 55 proceeds to step S106. At step S106, the controller 55 determines whether the measured temperature Tm is higher than or equal to a predetermined primary two-phase high-temperature (HT) stop temperature Th2. The primary two-phase HT stop temperature Th2 is a value of the HT stop temperature Th that is set when the modulation method is the two-phase modulation and the field weakening control is not being executed, that is, when the normal control is being executed. The primary two-phase HT stop temperature Th2 is set to be higher than the three-phase HT stop temperature Th1.

If the measured temperature Tm is lower than the primary two-phase HT stop temperature Th2, the controller 55 ends the HT stop control process without further processing. In contrast, if the measured temperature Tm is higher than or equal to the primary two-phase HT stop temperature Th2, the controller 55 executes the stop process for stopping the electric motor 13 at step S104 and ends the HT stop control process.

If the field weakening control is being executed, the controller 55 makes a positive determination at step S105 and proceeds to step S107. At step S107, the controller 55 determines whether the measured temperature Tm is higher than or equal to a predetermined secondary two-phase high-temperature (HT) stop temperature Th3. The secondary two-phase HT stop temperature Th3 is a value of the HT stop temperature Th that is set when the modulation method is the two-phase modulation and the field weakening control is being executed. The secondary two-phase HT stop temperature Th3 is set to be higher than the three-phase HT stop temperature Th1 and higher than the primary two-phase HT stop temperature Th2. That is, the following expression is satisfied: the three-phase HT stop temperature Th1<the primary two-phase HT stop temperature Th2<the secondary two-phase HT stop temperature Th 3<the operation upper limit temperature Tmax.

If the measured temperature Tm is lower than the secondary two-phase HT stop temperature Th3, the controller 55 ends the HT stop control process without further processing. In contrast, if the measured temperature Tm is higher than or equal to the secondary two-phase HT stop temperature Th3, the controller 55 executes the stop process for stopping the electric motor 13 at step S104 and ends the HT stop control process. In the present embodiment, the controller 55 corresponds to a high-temperature (HT) stop controller and a high-temperature (HT) stop temperature setting section.

The LT stop control process will now be described. The LT stop control process is configured to stop operation of the motor-driven compressor 10 when the measured temperature Tm is lowered to or below a predetermined LT stop temperature Ti. The LT stop temperature Ti is set to be higher than the operation lower limit temperature Tmin. The controller 55 varies the LT stop temperature Ti in accordance with the control mode of the inverter 31. The details of the LT stop control process will now be described in combination with the control for varying the LT stop temperature Ti.

Figure 4:
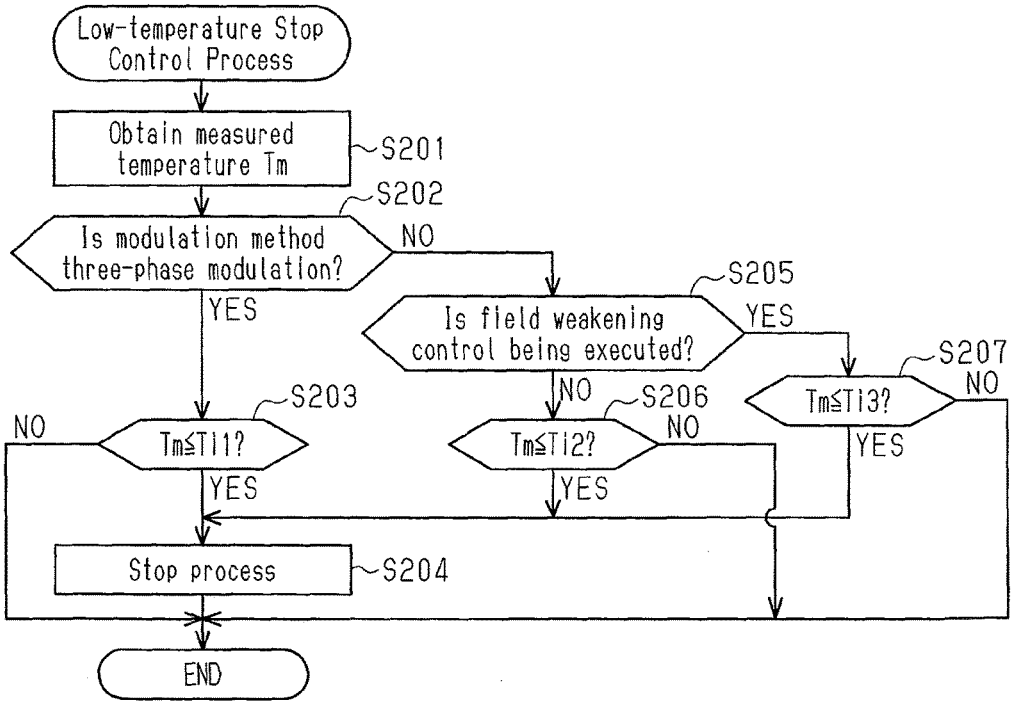
FIG. 4 is a flowchart of a low-temperature (LT) stop control process.

As shown in FIG. 4, the controller 55 obtains the measured temperature Tm from the measurement result of the temperature sensor 53 at step S201. Then, at step S202, the controller 55 determines whether the current modulation method is the three-phase modulation. If the current modulation method is the three-phase modulation, the controller 55 makes a positive determination at step S202 and proceeds to step S203. At step S203, the controller 55 determines whether the measured temperature Tm obtained at step S201 is lower than or equal to a predetermined three-phase low-temperature (LT) stop temperature Ti1. The three-phase LT stop temperature Ti1 is a value of the LT stop temperature Ti that is set when the modulation method is the three-phase modulation.

If the measured temperature Tm is higher than the three-phase LT stop temperature Ti1, the controller 55 ends the HT stop control process without further processing. In contrast, if the measured temperature Tm is lower than or equal to the three-phase LT stop temperature Ti1, the controller 55 executes the stop process for stopping the electric motor 13 at step S204 and ends the LT stop control process.

If the current modulation method is not the three-phase modulation, that is, if the current modulation is the two-phase modulation, the controller 55 makes a negative determination at step S202 and proceeds to step S205 as shown in FIG. 4. At step S205, the controller 55 determines whether the field weakening control is being executed. If the field weakening control is not being executed, the controller 55 proceeds to step S206 and determines whether the measured temperature Tm is lower than or equal to a predetermined primary two-phase low-temperature (LT) stop temperature Ti2. The primary two-phase LT stop temperature Ti2 is a value of the LT stop temperature Ti that is set when the modulation method is the two-phase modulation and the field weakening control is not being executed (that is, when the normal control is being executed). The primary two-phase LT stop temperature Ti2 is set to be higher than the three-phase LT stop temperature Ti1.

If the measured temperature Tm is higher than the primary two-phase LT stop temperature Ti2, the controller 55 ends the LT stop control process without further processing. In contrast, if the measured temperature Tm is lower than or equal to the primary two-phase LT stop temperature Ti2, the controller 55 executes the stop process for stopping the electric motor 13 at step S204 and ends the LT stop control process.

If the field weakening control is being executed, the controller 55 makes a positive determination at step S205 and proceeds to step S207. At step S207, the controller 55 determines whether the measured temperature Tm is lower than or equal to a predetermined secondary two-phase low-temperature (LT) stop temperature Ti3. The secondary two-phase LT stop temperature Ti3 is a value of the LT stop temperature Ti that is set when the modulation method is the two-phase modulation and the field weakening control is being executed. The secondary two-phase LT stop temperature Ti3 is set to be higher than the three-phase LT stop temperature Ti1 and higher than the primary two-phase LT stop temperature Ti2. That is, the following expression is satisfied: the secondary two-phase LT stop temperature Ti3>the primary two-phase LT stop temperature Ti2>three-phase LT stop temperature Ti1>the operation lower limit temperature Tmin.

If the measured temperature Tm is higher than the secondary two-phase LT stop temperature Ti3, the controller 55 ends the LT stop control process without further processing. In contrast, if the measured temperature Tm is lower than or equal to the secondary two-phase LT stop temperature Ti3, the controller 55 executes the stop process for stopping the electric motor 13 at step 3204 and ends the LT stop control process. In the present embodiment, the controller 55 corresponds to a low-temperature (LT) stop controller and a low-temperature (LT) stop temperature setting section.

Figure 5:
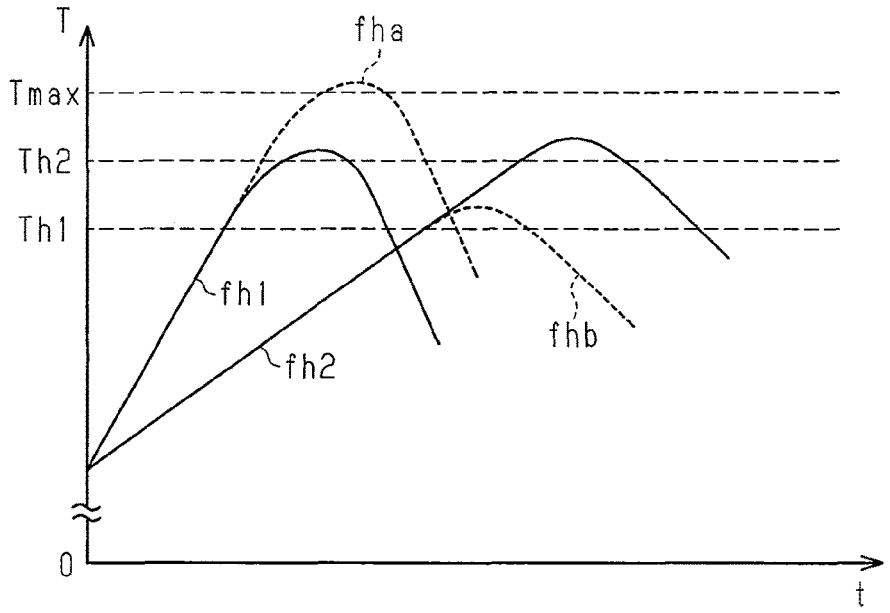
FIG. 5 is a graph showing changes over time of the temperature of the inverter in a high-temperature state.

Operation of the present embodiment will now be described with reference to FIGS. 5 and 6. FIG. 5 is a graph showing examples of changes over time of the temperature of the inverter 31 in a high-temperature state, and FIG. 6 is a graph showing examples of changes over time of the temperature of the inverter 31 in a low-temperature state.

In FIG. 5, a line fh1 represents an example of temperature change in a case in which the modulation method is the three-phase modulation, and a line fh2 represents an example of temperature change in a case in which the modulation method is the two-phase modulation and the field weakening control is not being executed.

Figure 6:
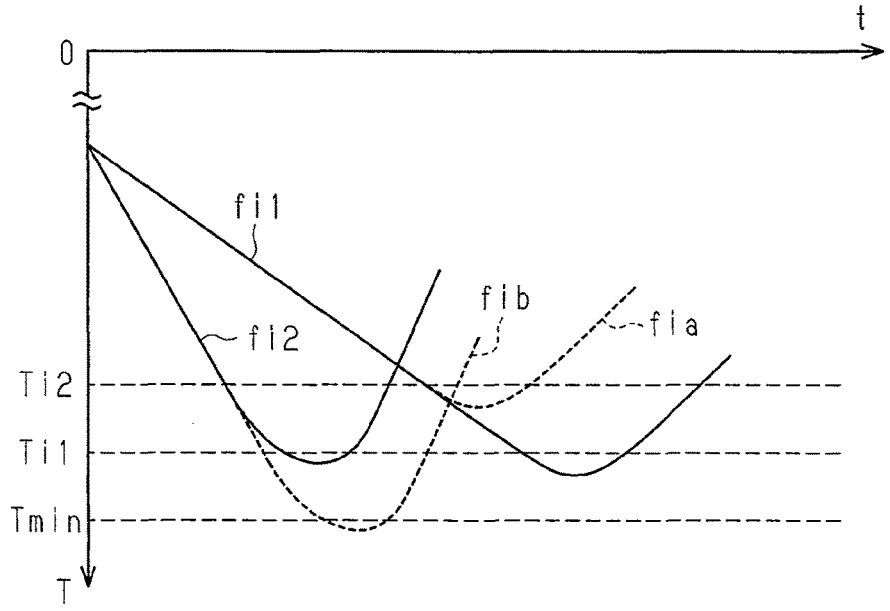
FIG. 6 is a graph showing changes over time of the temperature of the inverter in a low-temperature state.

Likewise, in FIG. 6, a line fi1 represents an example of temperature change in a case in which the modulation method is the three-phase modulation, and a line fi2 represents an example of temperature change in a case in which the modulation method is the two-phase modulation and the field weakening control is not being executed.

For the illustrative purposes, FIG. 5 schematically shows the three-phase HT stop temperature Th1 and the primary two-phase HT stop temperature Th2 in combination with the operation upper limit temperature Tmax. In reality, the measured temperature Tm may be different from the temperature of the inverter 31. Thus, the motor-driven compressor 10 does not necessarily stop operating each time the temperature of the inverter 31 is higher than or equal to the three-phase HT stop temperature Th1 or the primary two-phase HT stop temperature Th2. Strictly speaking, the temperature employed to determine whether operation should be stopped is the measured temperature Tm. The same applies to FIG. 6.

First, a case of high temperature will be described. As described above, the amount of heat generation of the inverter 31 is more likely to be increased when the modulation method is the three-phase modulation than when the modulation method is the two-phase modulation. Thus, as shown in FIG. 5, the rate of temperature increase is more likely to be increased in the three-phase modulation than in the two-phase modulation. Specifically, the inclination of the line fh1, which corresponds to the three-phase modulation, is greater than the inclination of the line fh2, which corresponds to the two-phase modulation.

Also, because of some factors, the temperature of the inverter 31 may not be lowered immediately based on stopping of the electric motor 13. The factors include, for example, electric discharge of the smoothing capacitor C1 and the generation of counter electromotive force that accompanies stopping of periodic ON-OFF operations of the power switching elements Qu1 to Qw2.

A time lag may occur from when the measured temperature Tm reaches the HT stop temperature Th to when the electric motor 13 actually stops. The temperature increase during the time lag is likely to be great in the three-phase modulation, in which the rate of temperature increase is high. Further, the amount of difference between the measured temperature Tm and the temperature of the inverter 31 may be more likely to be increased in the three-phase modulation, in which the amount of heat generation is relatively great, than in the two-phase modulation, in which the amount of heat generation is relatively small.

In a case in which the modulation method is the three-phase modulation under such a situation, if the operation of the motor-driven compressor 10 is stopped when the measured temperature Tm is higher than or equal to the primary two-phase HT stop temperature Th2, not the three-phase HT stop temperature Th1, the temperature of the inverter 31 may exceed the operation upper limit temperature Tmax as indicated by a broken line fha in FIG. 5.

In contrast, in the present embodiment, when the modulation method is the three-phase modulation, the operation of the motor-driven compressor 10 is stopped base on the fact that the measured temperature Tm is higher than or equal to the three-phase HT stop temperature Th1, which is lower than the primary two-phase HT stop temperature Th2. Accordingly, the temperature of the inverter 31 is unlikely to exceed the operation upper limit temperature Tmax.

When the modulation method is the two-phase modulation, the rate of temperature increase is lower than in the three-phase modulation. Thus, in a case in which the modulation method is the two-phase modulation, if the operation of the motor-driven compressor 10 is stopped when the measured temperature Tm is higher than or equal to the three-phase HT stop temperature Th1, the operation of the motor-driven compressor 10 is stopped in a state in which the difference between the temperature of the inverter 31 and the operation upper limit temperature Tmax is excessively great, for example, as indicated by a broken line fhb in FIG. 5. In this case, the operation of the motor-driven compressor 10 is stopped even though the normal operation is allowed to continue. This may provide the driver with a sense of discomfort.

In contrast, in the present embodiment, when the modulation method is the two-phase modulation, the operation of the motor-driven compressor 10 is stopped when the measured temperature Tm is higher than or equal to the two-phase HT stop temperature Th2, which is higher than the three-phase HT stop temperature Th1. This makes it unlikely that the motor-driven compressor 10 will be stopped even though the normal operation is allowed to continue.

Next, a case of low temperature will be described. In this case, the amount of heat generation is more likely to be decreased when the modulation method is the two-phase modulation than when the modulation method is the three-phase modulation. Thus, as shown in FIG. 6, the rate of temperature decrease is more likely to be increased in the two-phase modulation than in the three-phase modulation. Specifically, the inclination of the line fi2, which corresponds to the two-phase modulation, is greater than the inclination of the line fi1, which corresponds to the three-phase modulation.

Even after the electric motor 13 is stopped, the temperature of the inverter 31 may be lowered due to the cooling effect of the refrigerant that has been drawn into the housing immediately before the electric motor 13 is stopped.

A time lag may occur from when the electric motor 13 actually stops to when the measured temperature Tm reaches the HT stop temperature Th. The temperature decrease during the time lag is likely to be great in the two-phase modulation, in which the rate of temperature decrease is high.

In a case in which the modulation method is the two-phase modulation under such a situation, if the operation of the motor-driven compressor 10 is stopped when the measured temperature Tm is lower than or equal to the three-phase LT stop temperature Ti1, not the primary two-phase LT stop temperature Ti2, the temperature of the inverter 31 may be lowered to or below the operation lower limit temperature Tmin as indicated by a broken line fib in FIG. 6.

In contrast, in the present embodiment, when the modulation method is the two-phase modulation, the operation of the motor-driven compressor 10 is stopped when the measured temperature Tm is lower than or equal to the primary two-phase LT stop temperature Ti2, which is higher than the three-phase LT stop temperature Ti1. Accordingly, the temperature of the inverter 31 is unlikely to be lowered below the operation lower limit temperature Tmin.

When the modulation method is the three-phase modulation, the rate of temperature decrease is lower than in the two-phase modulation. Thus, in a case in which the modulation method is the three-phase modulation, if the operation of the motor-driven compressor 10 is stopped when that the measured temperature Tm is lower than or equal to the two-phase HT stop temperature Ti2, the operation of the motor-driven compressor 10 is stopped in a state in which the difference between the temperature of the inverter 31 and the operation lower limit temperature Tmin is excessively great, for example, as indicated by a broken line fia in FIG. 6. In this case, the operation of the motor-driven compressor 10 is stopped even though the normal operation is allowed to continue. This may provide the driver with a sense of discomfort.

In contrast, in the present embodiment, when the modulation method is the three-phase modulation, the operation of the motor-driven compressor 10 is stopped when that the measured temperature Tm is lower than or equal to the three-phase LT stop temperature Ti1, which is lower than the primary two-phase LT stop temperature Ti2. This makes it unlikely that the motor-driven compressor 10 will be stopped even though the normal operation is allowed to continue.

The present embodiment, which has been described, has the following advantages.

(1) The motor-driven compressor 10 includes the compression portion 12, which compresses refrigerant serving as fluid, the electric motor 13, which drives the compression portion 12, the inverter 31, which is a drive circuit configured to drive the electric motor 13, the temperature sensor 53, which measures the temperature of the inverter 31, and the controller 55, which controls the inverter 31. When the measured temperature Tm measured by the temperature sensor 53 is higher than or equal to the predetermined HT stop temperature Th, the controller 55 executes the HT stop control process for stopping the electric motor 13. In the HT stop control process, when the modulation method is the three-phase modulation, the controller 55 sets the HT stop temperature Th to the three-phase HT stop temperature Th1. When the modulation method is the two-phase modulation, the controller 55 sets the HT stop temperature Th to one of the two-phase HT stop temperatures Th2, Th3, which are higher than the three-phase HT stop temperature Th1.

With this configuration, when the modulation method is the three-phase modulation, in which the amount of heat generation of the inverter 31 is relatively great, so that the temperature is likely to increase, the HT stop temperature Th is set to the relatively low three-phase HT stop temperature Th1. Thus, the temperature of the inverter 31 (specifically, the power module 52) is restrained from being excessively increased. In contrast, when the modulation method is the two-phase modulation, the HT stop temperature Th is set to one of the relatively low two-phase HT stop temperatures Th 2, Th3. Thus, the operation of the motor-driven compressor 10 is easily continued. Since the amount of heat generation is small and the temperature is not easily increased in the two-phase modulation, the temperature of the inverter 31 is not likely to be excessively increased even if the HT stop temperature Th is set to a relatively high temperature as described above. This allows the motor-driven compressor 10 to continue to operate while restraining the temperature of the inverter 31 from being excessively increased.

(2) The inverter 31 includes the power switching elements Qu1 to Qw2, which operate normally when the temperature is lower than or equal to the predetermined operation upper limit temperature Tmax. The inverter 31 executes periodic ON-OFF operation on the power switching elements Qu1 to Qw2 to drive the electric motor 13. The HT stop temperature Th is set to be lower than the operation upper limit temperature Tmax. Accordingly, the electric motor 13 is stopped through the HT stop control process before the measured temperature Tm becomes the operation upper limit temperature Tmax. This restrains the temperature of the inverter 31 from exceeding the operation upper limit temperature Tmax.

(3) The inverter 31 and the housing 11 are thermally coupled to each other. Thus, the inverter 31 is cooled by the refrigerant that is drawn into the housing 11. The flow rate of the refrigerant drawn into the housing 11 depends on the rotational speed of the electric motor 13.

In a situation in which the modulation method is the three-phase modulation, the modulation method controller 61 shifts the modulation method from the three-phase modulation to the two-phase modulation when the predetermined two-phase modulation condition is met. The two-phase modulation condition includes the rotational speed of the electric motor 13 being greater than or equal to the threshold rotational speed.

In this configuration, since the rotational speed when the modulation method is the two-phase modulation is higher than the rotational speed when the modulation method is the three-phase modulation, the flow rate of the refrigerant drawn into the housing 11 is more likely to be increased in the case of the two-phase modulation than in the case of the three-phase modulation. Accordingly, the inverter 31 is cooled by the refrigerant more effectively when the modulation method is the two-phase modulation. Thus, even if the HT stop temperature Th when the modulation method is the two-phase modulation is set to one of the two-phase HT stop temperatures Th2, Th3, which are higher than the three-phase HT stop temperature Th1, the temperature of the inverter 31 is unlikely to exceed the operation upper limit temperature Tmax. Therefore, the motor-driven compressor 10 is allowed to continue to operate when the modulation method is the two-phase modulation.

(4) The controller 55 includes the field weakening controller 62, which executes field weakening control on the electric motor 13 when the predetermined field weakening condition is met. Thus, even in a case in which the power source voltage is low, the motor-driven compressor 10 is allowed to operate at a high rotational speed while maintaining a high constant torque.

The amount of heat generation of the inverter 31 is greater during the field weakening control than during the normal control is executed. Thus, since the temperature of the inverter 31 is not easily increased during the field weakening control, the temperature of the inverter 31 is not likely to exceed the operation upper limit temperature Tmax even if the HT stop temperature Th in the field weakening control is increased. Correspondingly, the controller 55 of the present embodiment sets the HT stop temperature Th to the primary two-phase HT stop temperature Th2 when the modulation method is the two-phase modulation and the field weakening control is not being executed. Also, the controller 55 sets the HT stop temperature Th to the secondary two-phase HT stop temperature Th3, which is higher than the primary two-phase HT stop temperature Th2, when the modulation method is the two-phase modulation and the field weakening control is being executed. Therefore, when the modulation method is the two-phase modulation during the field weakening control, the motor-driven compressor 10 is allowed to continue to operate while the temperature of the inverter 31 is restrained from exceeding the operation upper limit temperature Tmax.

(5) When the measured temperature Tm measured by the temperature sensor 53 falls to or below the predetermined LT stop temperature Ti, the controller 55 executes the LT stop control process for stopping the electric motor 13. In the LT stop control process, when the modulation method is the three-phase modulation, the controller 55 sets the LT stop temperature Ti to the three-phase LT stop temperature Ti1. When the modulation method is the two-phase modulation, the controller 55 sets the LT stop temperature Ti to one of the two-phase LT stop temperatures Ti2, Ti3, which are higher than the three-phase LT stop temperature Ti1.

With this configuration, when the modulation method is the two-phase modulation, in which the amount of heat generation of the inverter 31 is relatively small, so that the temperature is likely to decrease, the LT stop temperature Ti is set to one of the relatively high two-phase LT stop temperatures Ti2 and Ti3. Thus, the temperature of the inverter 31 (specifically, the power module 52) is prevented from being excessively lowered. In contrast, when the modulation method is the three-phase modulation, the LT stop temperature Ti is set to the relatively low three-phase LT stop temperature Ti1. Thus, the operation of the motor-driven compressor 10 is easily continued. Since the amount of heat generation is great and the temperature is not easily decreased in the three-phase modulation, the temperature of the inverter 31 is not likely to be excessively decreased even if the LT stop temperature Ti is set to a relatively low temperature as described above. This allows the motor-driven compressor 10 to continue to operate while restraining the temperature of the inverter 31 from being excessively lowered.

(6) The power switching elements Qu1 to Qw2 operate normally when the temperature is higher than or equal to the predetermined operation lower limit temperature Tmin. The LT stop temperature Ti is set to be higher than the operation lower limit temperature Tmin. Accordingly, the electric motor 13 is stopped through the LT stop control process before the measured temperature Tm becomes the operation lower limit temperature Tmin. This restrains the temperature of the inverter 31 from being lowered below the operation lower limit temperature Tmin.

(7) As in the case of the item (3) of the advantages, in which the two-phase modulation condition is set, the inverter 31 is less likely to be cooled by the refrigerant when the modulation method is the three-phase modulation than when the modulation method is the two-phase modulation. Thus, even if the LT stop temperature Ti when the modulation method is the three-phase modulation is set to the three-phase LT stop temperature Ti1, which is lower than the primary two-phase LT stop temperature Ti2, the temperature of the inverter 31 is unlikely to be lowered below the operation lower limit temperature Tmin. Therefore, the operation of the motor-driven compressor 10 is allowed to continue when the modulation method is the three-phase modulation.

(8) Since the amount of heat generation of the inverter 31 is more likely to be decreased during the field weakening control than during the normal control, the temperature of the inverter 31 is more easily lowered during the field weakening control than during the normal control. Correspondingly, the controller 55 sets the LT stop temperature Ti to the primary two-phase LT stop temperature Ti2 when the modulation method is the two-phase modulation and the field weakening control is not being executed. Also, the controller 55 sets the HT stop temperature Ti to the secondary two-phase LT stop temperature Ti3, which is higher than the primary two-phase LT stop temperature Ti2, when the modulation method is the two-phase modulation and the field weakening control is being executed. Therefore, when the modulation method is the two-phase modulation during the field weakening control, the motor-driven compressor 10 is allowed to continue to operate while the temperature of the inverter 31 is restrained from being lowered below the operation lower limit temperature Tmin.

The above embodiment may be modified as follows.

The temperature sensor 53 may detect the temperature of the circuit board 51 as a temperature that directly indicates the temperature of the inverter 31. That is, the temperature sensor 53 may be modified as long as it detects the temperature of the inverter 31 directly or indirectly. As long as the temperature sensor 53 is located in or on the inverter 31, the temperature sensor 53 may be located at any position.

The specific configuration of each of the power switching elements Qu1 to Qw2 is not limited to an insulated gate bipolar transistor (IGBT), but may be any switching element such as a power MOSFET.

In the illustrated embodiment, the two-phase modulation condition is defined by both of the rotational speed and the modulation factor, but may be defined by only one of these.

The field weakening controller 62 may be omitted. That is, the field weakening control does not need to be executed. In this case, the secondary two-phase HT stop temperature Th3 and the secondary two-phase LT stop temperature Ti3 may be omitted.

In the illustrated embodiment, the controller 55 is configured to execute both of the HT stop control process and the LT stop control process, but may be configured to execute only one of these.

The case 32 may be attached to any position on the housing 11.

The power module 52 and the base member 41 of the inverter 31 do not necessarily need to contact each other, but may be separated from each other. Even in this case, the ambient temperature in the case 32 is regulated by the refrigerant, and the temperature of the power module 52 is regulated, accordingly.

The base member 41 may be omitted, and the cover member 42 may be fixed to the wall portion 11*c* of the housing 11. In this case, the inverter 31 is accommodated in the space defined by the cover member 42 and the wall portion 11*c* of the housing 11. Even in this configuration, the inverter 31 and the housing 11 are thermally coupled to each other. That is, any configuration may be employed that thermally couple the inverter 31 and the housing 11 to each other.

The two-phase modulation is not limited to the method that uses both of the upper arm and the lower arm, but may be a method that uses only the lower arm. In other words, the two-phase modulation may stop operation of only the power switching elements Qu2, Qv2, Qw2 of the lower arm.

The motor-driven compressor 10 may be mounted on any structure other than a vehicle.

In the illustrated embodiment, the motor-driven compressor 10 is used in the vehicle air conditioner 100, but may be used in any other device. For example, if the vehicle is a fuel cell vehicle (FCV), which mounts a fuel cell, the motor-driven compressor 10 may be used in a supplying device that supplies air to the fuel cell. That is, the fluid to be compressed may be any fluid such as refrigerant or air.

Therefore, the present examples and embodiments are to be considered as illustrative and not restrictive and the invention is not to be limited to the details given herein, but may be modified within the scope and equivalence of the appended claims.

The invention claimed is:

1. A motor-driven compressor comprising:

a housing, into which fluid is drawn;

a compression portion accommodated in the housing, wherein the compression portion compresses and discharges the fluid;

an electric motor accommodated in the housing, wherein the electric motor drives the compression portion;

a drive circuit, which drives the electric motor;

a modulation method controller, which sets a modulation method of the drive circuit to a three-phase modulation or a two-phase modulation;

a temperature measuring section, which measures a temperature of the drive circuit;

a high-temperature (HT) stop controller, which stops the electric motor when the temperature measured by the temperature measuring section is higher than or equal to a predetermined high-temperature (HT) stop temperature; and a high-temperature (HT) stop temperature setting section, wherein, when the modulation method is the three-phase modulation, the HT stop temperature setting section sets the HT stop temperature to a three-phase high-temperature (HT) stop temperature, and when the modulation method is the two-phase modulation, the HT stop temperature setting section sets the HT stop temperature to a two-phase high-temperature (HT) stop temperature, which is higher than the three-phase HT stop temperature.

2. The motor-driven compressor according to claim 1, wherein the drive circuit and the housing are thermally coupled to each other, in a situation in which the modulation method is the three-phase modulation, the modulation method controller shifts the modulation method from the three-phase modulation to the two-phase modulation when a predetermined two-phase modulation condition is met, and the two-phase modulation condition includes a rotational speed of the electric motor being greater than or equal to a predetermined threshold rotational speed.

3. The motor-driven compressor according to claim 1, further comprising a field weakening controller, which executes field weakening control on the electric motor when a predetermined field weakening condition is met, wherein when the modulation method is the two-phase modulation and the field weakening control is not being executed, the HT stop temperature setting section sets the HT stop temperature to a primary two-phase HT stop temperature, which is higher than the three-phase HT stop temperature, and when the modulation method is the two-phase modulation and the field weakening control is being executed, the HT stop temperature setting section sets the HT stop temperature to a secondary two-phase HT stop temperature, which is higher than the primary two-phase HT stop temperature.

4. The motor-driven compressor according to claim 1, wherein the drive circuit includes switching elements, which operates normally when a temperature of the drive circuit is lower than or equal to an operation upper limit temperature, the drive circuit periodically switches ON and OFF the switching elements to drive the electric motor, and the HT stop temperature is set to be lower than the operation upper limit temperature.

5. A motor-driven compressor comprising:

a housing, into which fluid is drawn;

a compression portion accommodated in the housing, wherein the compression portion compresses and discharges the fluid;

an electric motor accommodated in the housing, wherein the electric motor drives the compression portion;

a drive circuit, which drives the electric motor;

a modulation method controller, which sets a modulation method of the drive circuit to a three-phase modulation or a two-phase modulation;

a temperature measuring section, which measures a temperature of the drive circuit;

a low-temperature (LT) stop controller, which stops the electric motor when the temperature measured by the temperature measuring section is lower than or equal to a predetermined low-temperature (LT) stop temperature; and a low-temperature (LT) stop temperature setting section, wherein, when the modulation method is the three-phase modulation, the LT stop temperature setting section sets the LT stop temperature to a three-phase low-temperature (LT) stop temperature, and when the modulation method is the two-phase modulation, the LT stop temperature setting section sets the LT stop temperature to a two-phase low-temperature (LT) stop temperature, which is higher than the three-phase LT stop temperature.

6. The motor-driven compressor according to claim 5, wherein the drive circuit and the housing are thermally coupled to each other, in a situation in which the modulation method is the three-phase modulation, the modulation method controller shifts the modulation method from the three-phase modulation to the two-phase modulation when a predetermined two-phase modulation condition is met, and the two-phase modulation condition includes a rotational speed of the electric motor being greater than or equal to a predetermined threshold rotational speed.

7. The motor-driven compressor according to claim 5, further comprising a field weakening controller, which executes field weakening control on the electric motor when a predetermined field weakening condition is met, wherein when the modulation method is the two-phase modulation and the field weakening control is not being executed, the LT stop temperature setting section sets the LT stop temperature to a primary two-phase LT stop temperature, which is higher than the three-phase LT stop temperature, and when the modulation method is the two-phase modulation and the field weakening control is being executed, the LT stop temperature setting section sets the LT stop temperature to a secondary two-phase LT stop temperature, which is higher than the primary two-phase LT stop temperature.

8. The motor-driven compressor according to any one of claim 5, wherein the drive circuit includes switching elements, which operate normally when a temperature of the drive circuit is higher than or equal to an operation lower limit temperature, the drive circuit periodically switches ON and OFF the switching elements to drive the electric motor, and the LT stop temperature is set to be higher than the operation lower limit temperature.

* * * * *